US007629750B2

(12) United States Patent
Park et al.

(10) Patent No.: US 7,629,750 B2
(45) Date of Patent: Dec. 8, 2009

(54) LAMP DRIVING DEVICE AND DRIVING METHOD THEREOF

(75) Inventors: Sin Kyun Park, Gyeongsangbuk-do (KR); Kang Ju Lee, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 474 days.

(21) Appl. No.: 11/451,483

(22) Filed: Jun. 13, 2006

(65) Prior Publication Data

US 2007/0002001 A1 Jan. 4, 2007

(30) Foreign Application Priority Data

Jun. 29, 2005 (KR) ..... 10-2005-0057116

(51) Int. Cl.
*H05B 37/00* (2006.01)

(52) U.S. Cl. ..... 315/94; 315/101; 315/106; 315/107

(58) Field of Classification Search ..... 315/94, 315/101, 102, 105, 106, 107
See application file for complete search history.

(56) References Cited

U.S. PATENT DOCUMENTS

| | | | | |
|---|---|---|---|---|
| 5,654,605 | A | 8/1997 | Kawashima | |
| 5,798,614 | A * | 8/1998 | Bishop | 315/107 |
| 6,127,785 | A | 10/2000 | Williams | |
| 2003/0160574 | A1 | 8/2003 | Gray | |

* cited by examiner

*Primary Examiner*—David Hung Vu
(74) *Attorney, Agent, or Firm*—Holland & Knight LLP

(57) ABSTRACT

A lamp driving device includes a switch circuit for supplying a signal; a transformer which boosts a voltage of the signal from the switch circuit and supplies the boosted voltage to at least one lamp; a safety circuit which compares a threshold value with at least one of the boosted voltage and a current through the lamp, and intercepts at least one of the boosted voltage and the current through the lamp in accordance with the comparison result; and a warming part for warming the lamp in an early stage with a voltage less than or equal to the threshold value.

15 Claims, 11 Drawing Sheets

LAMP DRIVING DEVICE AND DRIVING METHOD THEREOF

This application claims the benefit of the Korean Patent Application No. P2005-0057116 filed on Jun. 29, 2005 which is hereby incorporated by reference.

BACKGROUND OF THE INVENTION

1. Field of the Invention

The present invention relates to a lamp, and more particularly to a lamp driving device and a driving method thereof. Although the present invention is suitable for a wide scope of applications, it is particularly suitable for preventing erroneous driving caused by the surrounding environment while observing safety standards.

2. Description of the Related Art

Among display devices for displaying images, a liquid crystal display ("LCD") device has had a broad scope of application because it is light, thin, and consumes little power. For example, LCD devices are used in office automation equipment, audio/video equipment, etc. In the LCD device, a desired picture is displayed on an LCD screen by controlling the amount of transmitted light through the LCD device in accordance with a video signal applied to a plurality of control switches forming a matrix.

In general, the LCD device is not a self luminous display device because it requires a separate light source, such as a backlight. The backlight for the liquid crystal display device can be a direct type or an edge type depending on the disposition of a lamp in the backlight. In the edge type backlight, a lamp is installed at an outer edge of a flat LCD panel of the LCD device and light propagates from the lamp through a transparent light guide panel to be incident onto the entire back surface of the LCD panel. In the direct type backlight, a plurality of lamps is disposed on a plane. A diffusion plate is installed between the lamp and the LCD panel to maintain a fixed gap between the LCD panel and the lamp.

The backlight can also be classified as a cold cathode fluorescent lamp type or an external electrode fluorescent lamp type depending on the type of the lamp used on the backlight. The cold cathode fluorescent lamp is formed of a glass tube and power is supplied to the lamp by inserting electrodes through both ends of the glass tube. The external electrode fluorescent lamp is also formed of a glass tube, but power is supplied to an electrode part formed of a metal material covering both ends of the glass tube.

FIG. 1 is a schematic diagram of a lamp driving device in accordance with the related art. Referring to FIG. 1, the lamp driving device 60 is connected to a plurality of lamps 36 and includes a switch circuit 46, such as an inverter, which converts a DC power Vin received from an external power source to into an AC signal. A transformer 48 is provided to boost the voltage of the AC signal generated by the inverter 46 and supplies the boosted AC signal to the lamps 36. A feedback circuit 42 is provided for detecting a current supplied to the lamp 36 by the inverter 46. A controller 44 of the lamp driving device 60 controls the inverter 46 in accordance with a feedback signal generated by the feedback circuit 42. The transformer 48 includes a primary winding 51 connected to the inverter 46; a secondary winding 53 which is synchronized with the primary winding 51 to generate an alternating current; and an auxiliary winding 52 disposed between the primary and secondary windings 51 and 53.

The lamp driving device 60 having such a structure should satisfy the safety standards with respect to a user's safety. The safety standards require that the current flowing through a user should be restricted to a current in milliamps (mA) of less than or equal to 0.7 fold of a system operation frequency in KHz when the user is in contact with the lamp driving device 60. To test compliance with the standards, a test lamp is fabricated based on the safety standards. For example, a no-load condition of about 2 KΩ is shown in FIG. 1 as a contact resistor 59, which corresponds to a contact between the user and the lamp driving device 60, and a normal resistance component of the lamp 36 is about 200 KΩ. When the lamp 36 is operated normally, a usable frequency is about 65 KHz and a voltage of the secondary winding 53 is about 1500V.

A resonance characteristic of the secondary winding 53 changes rapidly when the non-load value of 2 KΩ is in contact with the secondary winding 53. Generally, the secondary winding 53 is resonant in parallel, and a voltage gain of an input and an output in the parallel resonance is changed in proportion to the resistance component of a load. Thus, an equivalent resistance component 200 KΩ of the lamp 53 and the 2 KΩ no-load resistor 59 are connected in parallel so that the equivalent resistance appearing in the secondary winding 53 is about 22 KΩ (200 KΩ/2 KΩ) to generate a load change of about 1/100. Thus, a gain change of about 1/100 is also generated in the voltage of the secondary winding 53 to satisfy the safety standards. Quantitatively, a lamp safety standards limited current of a 65 KHz frequency usage is 46 mA (0.7×65). Further, the voltage of the secondary winding 53 is about 15V (1500×1/100) since the gain is 1/100, and the current passing through 2 KΩ becomes 7 mA according to Ohm's law, thereby satisfying the 46 mA upper limit required by the safety standards. A driving device is required that does not violate the safety standard for a user.

When driving a plurality of lamps 36, e.g., in case of driving ten lamps 36, the equivalent resistance of the lamp 36 becomes 20 KΩ, and at this moment, if the user is connected to the system, i.e., 2 KΩ resistance is connected as the no-load resistor 59 of the system, the gain of the output voltage becomes 1/10. Accordingly, the voltage of the second winding 53 becomes about 150V so that the current flowing in the no-load resistor 59 becomes 70 mA, thereby violating the safety standards.

SUMMARY OF THE INVENTION

Accordingly, the present invention is directed to a lamp driving device and a driving method thereof, which substantially obviate one or more problems due to limitations and disadvantages of the related art.

An object of the present invention to provide a lamp driving device adapted for preventing an erroneous driving caused by the surrounding environment.

Another object of the present invention to provide a method for preventing an erroneous driving of a lamp caused by the surrounding environment.

Another object of the present invention to provide a lamp driving device that satisfies safety standards.

Another object of the present invention to provide a method of driving a lamp that satisfies safety standards.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a lamp driving device includes a switch circuit for supplying a signal; a transformer which boosts a voltage of the signal from the switch circuit and supplies the boosted voltage to at least one lamp; a safety circuit which compares a threshold value with at least one of the boosted voltage and a current through the lamp, and intercepts at least one of the boosted voltage and the current through the lamp in accordance with the comparison result; and a warming part for warming the lamp in an early stage with a voltage less than or equal to the threshold value.

In another aspect, a lamp driving device includes a switch circuit for supplying at least one of a voltage and a current for a lamp; a warming part for warming-up the lamp during a warm-up period; and a safety circuit for intercepting the at least one of the voltage and the current through the lamp and preventing a tube current feedback during the warm-up period.

In another aspect, a lamp driving method using a lamp driving device including a switching circuit for supplying an AC signal and a transformer for boosting a voltage of the signal from the inverter and supplying the boosted voltage to a lamp includes warming the lamp for a fixed period with an offset voltage less than or equal to a threshold voltage that provides a current during a warm-up period when the lamp is turned on in the early stage.

In another aspect, a lamp driving device includes a switch circuit for supplying a signal; a transformer which boosts a voltage of the signal from the switch circuit and supplies the boosted voltage to at least one lamp; a feedback circuit for detecting a current through the at least one lamp; and a warming part generating an offset voltage that is lower than a threshold value and prevents the current through the at least one lamp during a warm-up period.

In another aspect, a method of driving a lamp in an LCD device includes supplying a voltage; boosting the voltage and supplying the boosted voltage to at least one lamp; comparing a threshold value with at least one of the boosted voltage and a current through the lamp, and intercepting at least one of the boosted voltage and the current through the lamp in accordance with the comparison result; and warming-up the lamp in an early stage with a voltage less than or equal to the threshold value.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
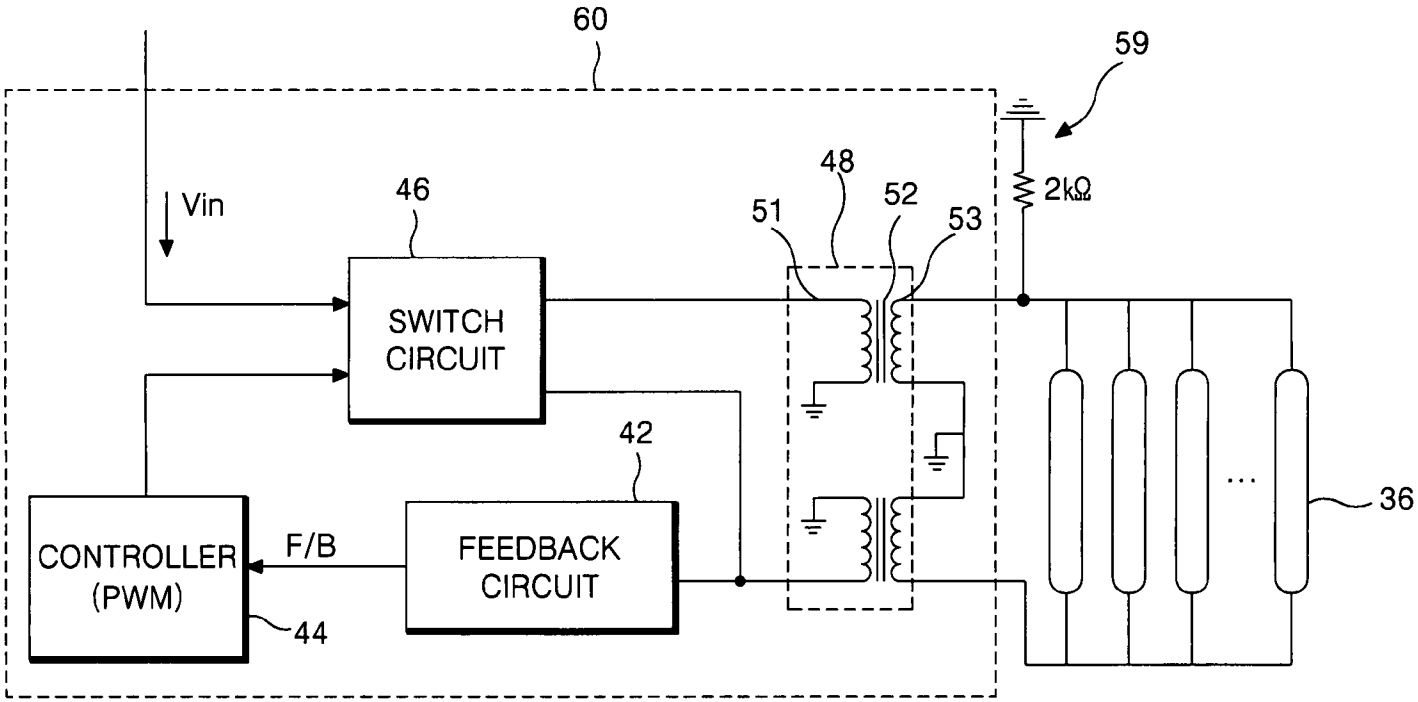
FIG. 1 RELATED ART
FIG. 1 is a schematic diagram of a lamp driving device in accordance with the related art.
Figure 2:
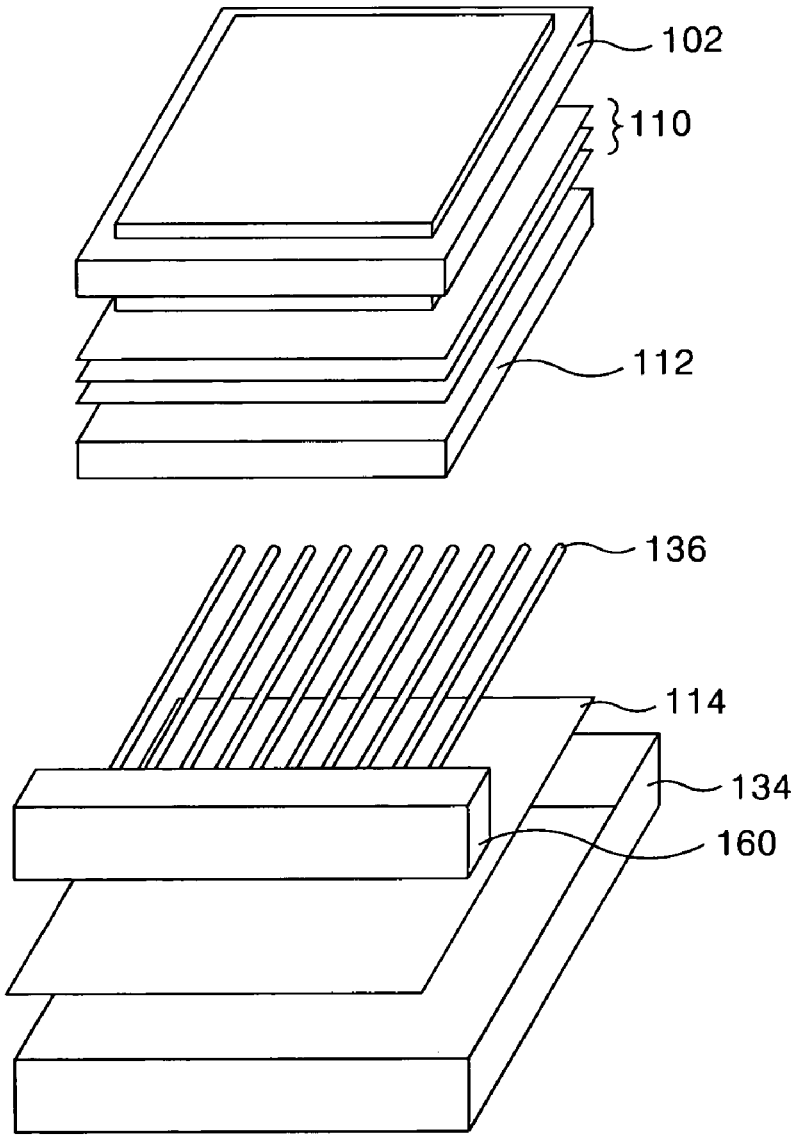
FIG. 2 is an exploded perspective view of an exemplary liquid crystal display device according to a first embodiment of the present invention.

FIG. 2 is an exploded perspective view of an exemplary liquid crystal display device according to a first embodiment of the present invention. Referring to FIG. 2, a direct type backlight for a liquid crystal display device includes a liquid crystal display panel 102 for displaying a picture; a backlight assembly including at least one lamp 136 provided with a fixed tube current for irradiating a uniform light onto the LCD panel 102; and a lamp driving device 160 for driving the backlight assembly.

The liquid crystal display panel 102 has liquid crystal cells arranged in a matrix between upper and lower substrates (not shown), and has pixel electrodes (not shown) and a common electrode (not shown) for applying electric field to each of the liquid crystal cells. Each of the pixel electrodes is connected to switching device, for example a thin film transistor. The pixel electrode drives a liquid crystal cell together with the common electrode in accordance with a data signal supplied through the thin film transistor, thereby displaying a picture corresponding to a video signal.

The backlight assembly includes: a lamp housing 134; a reflection sheet 114 facing the front surface of the lamp housing 134; a plurality of lamps 136 located on an upper part of the reflection sheet 114; a lamp driving device 160 for controlling the driving of the lamps 136; a diffusion plate 112; and an optical sheet 110. The lamp housing 134 prevents light emitted from each of the lamps 136 from leaking to the side and rear surfaces of the lamps 136, and reflects the light to the front surface, i.e., to the diffusion plate 112, thereby improving the efficiency of the light generated in the lamps 136. The reflection sheet 114 is disposed between the upper surface of the lamp housing 134 and the lamps 136 to reflect the light generated by the lamps 136 toward the LCD panel 102, thereby improving the light efficiency.

The diffusion plate 112 propagates the light emitted from the lamps 136 in the direction of the liquid crystal display panel 102 and enables the light to be incident onto the LCD panel 102 with a wide angle. The diffusion plate 112 is made by coating a light diffusion member on both sides of a film formed of a transparent resin. The optical sheets 110 narrows a viewing angle of the light exiting from the diffusion plate 112, such that a front brightness of the liquid crystal display device is improved and power consumption can be reduced.

Figure 3:
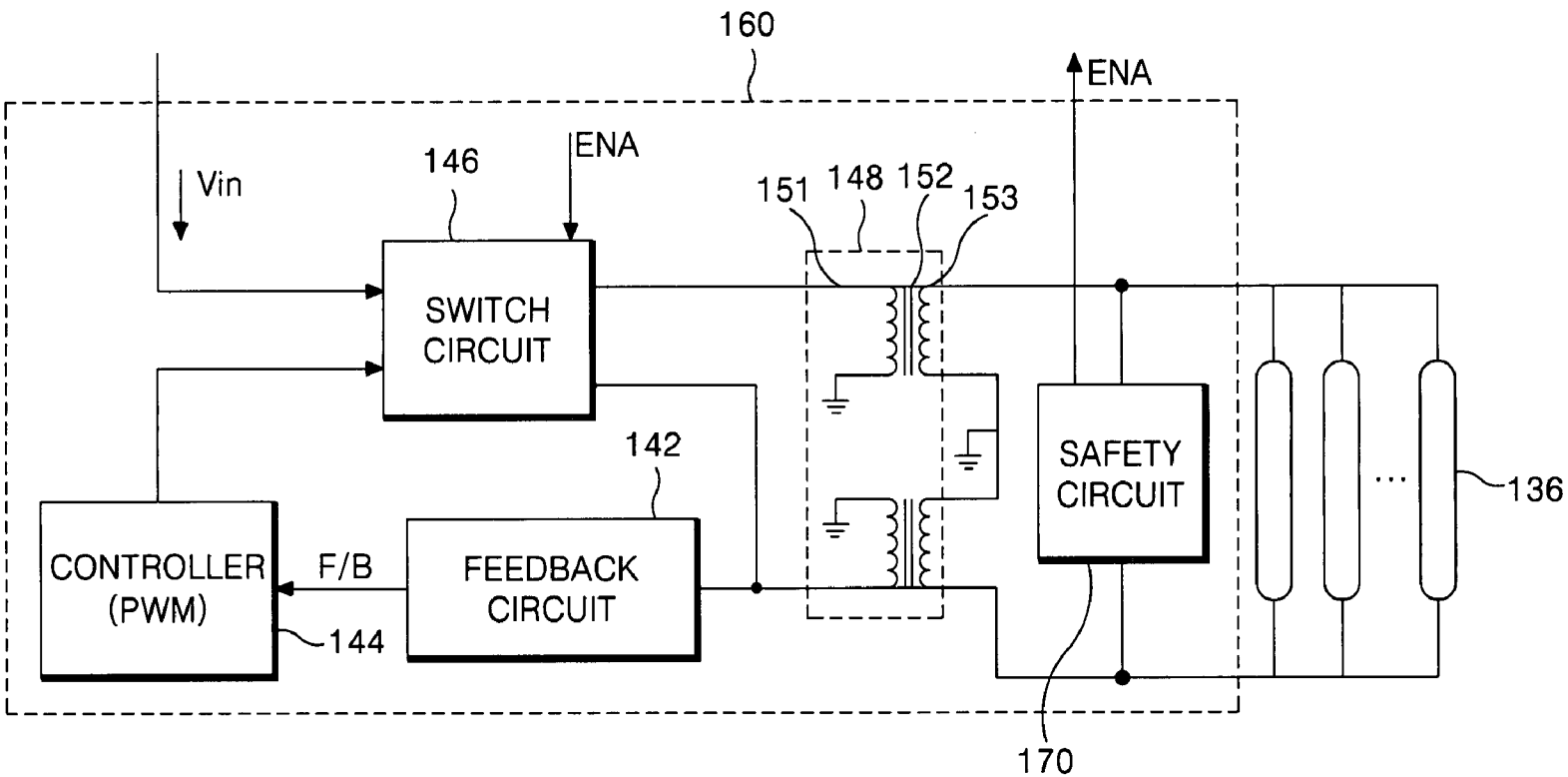
FIG. 3 is a schematic diagram of the lamp driving device of FIG. 2.

FIG. 3 is a schematic diagram of the lamp driving device of FIG. 2. Referring to FIG. 3, the lamp driving device 160 includes: a switch circuit 146 for converting a DC power Vin received from an external power source into an AC signal provided to a plurality of lamps 136; a transformer 148 which boosts the voltage of the AC signal generated by the switch circuit 146 and supplies the boosted AC signal to the lamps 136; a feedback circuit 142 for detecting a current supplied to the lamp 136 from the transformer 148; a controller 144 for controlling the switch circuit 146 in accordance with a feedback signal generated by the feedback circuit 142; and a safety circuit 170 which intercepts or maintains the current supplied to the lamps 136 by detecting the current provided by the transformer 148. Each of the lamps 136 includes a glass tube; inert gas within the glass tube; and a cathode and an anode which are installed at both ends of the glass tube. The inert gas is filled into the glass tube and a fluorescent material is spread on the inner wall of the glass tube.

A plurality of the switch circuits 146 receive the DC power from an external power source and is switched by use of a switching device included in the switch circuit 146, thereby converting the DC power into the AC signal. Each of the transformers 148 includes: a primary winding 151; a secondary winding 153 for generating an AC high voltage induced by an AC voltage provided to the primary winding 151 by the switch circuit 146; and an auxiliary winding 152 disposed between the primary winding 151 and the secondary winding 153. The transformer 148 boosts the voltage of the AC signal generated by the inverter 146 and supplies the boosted AC signal to the lamps 136.

The feedback circuit 142 detects the AC high voltage generated by the transformer 148 supplied to the lamp 136, thereby generating the feedback voltage. The feedback circuit 142 can be located at an output terminal of the lamp 136 to detect an output value outputted from the lamps 136. The controller 144 receives a feedback voltage F/B generated by the feedback circuit 142 to control the switching device included in the switch circuit 146.

The safety circuit 170 detects the AC high voltage, which is generated by the transformer 148 and is supplied to the lamps 136, inspects whether the AC high voltage is suitable according to the safety standards, and intercepts and maintains the current and voltage supplied to the lamps 136. The safety circuit 170 can supply a signal ENA that shuts down the switch circuit 146, thereby shutting down the whole lamp driving device. The safety circuit 170 can be connected between the lamps 136. The safety circuit 170 can also be connected to the feedback circuit 142 for inspecting the voltage and the current, which are supplied to the feedback circuit 142 or outputted from the feedback circuit 142. Thus, the safety circuit 170 can turn on and off the lamps 136 depending on the value of the current.

When the liquid crystal display device is turned on or is driven while the surrounding temperature is lower than a normal temperature, the activity of the gas within the lamp 136 decreases, thereby causing the impedance of the lamp 136 to be higher than at a normal temperature. Thus, a voltage higher than normal is required to maintain a fixed current flow. The applied voltage has an output curve similar to the curve shown in FIG. 4, and the shape of the early stage of the output curve is generated when the safety circuit 170 is operated.

Figure 4:
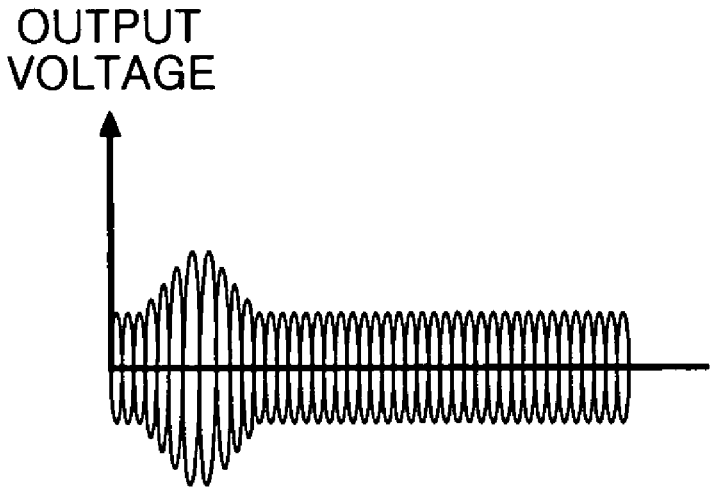
FIG. 4 is a diagram representing a early stage output voltage of the lamp driving device of FIG. 2.
Figure 5:
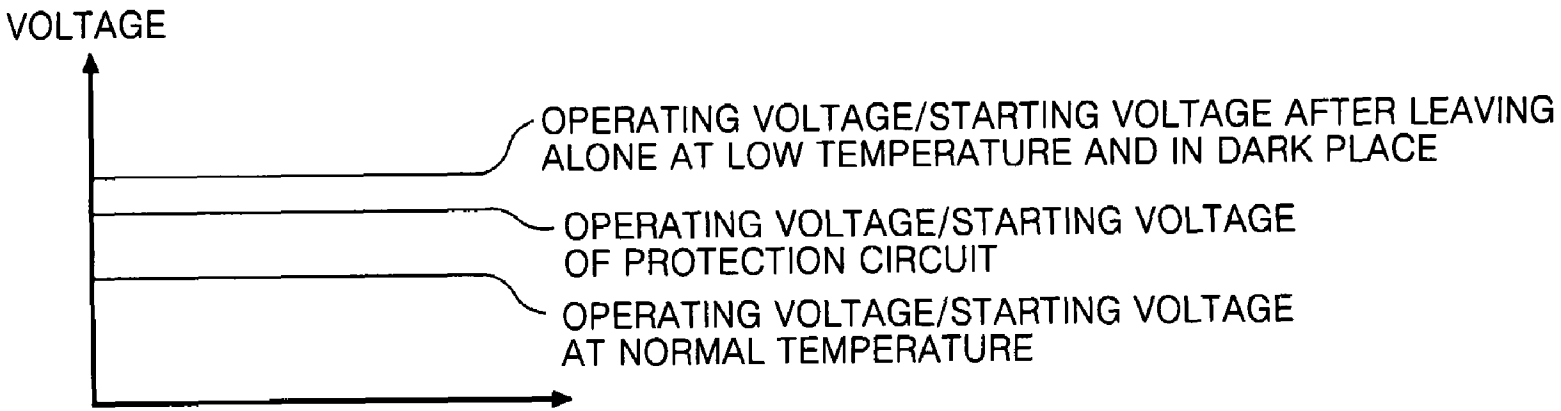
FIG. 5 is a diagram representing the size of an operating voltage and a starting voltage in accordance with the state of a lamp.
Figure 6:
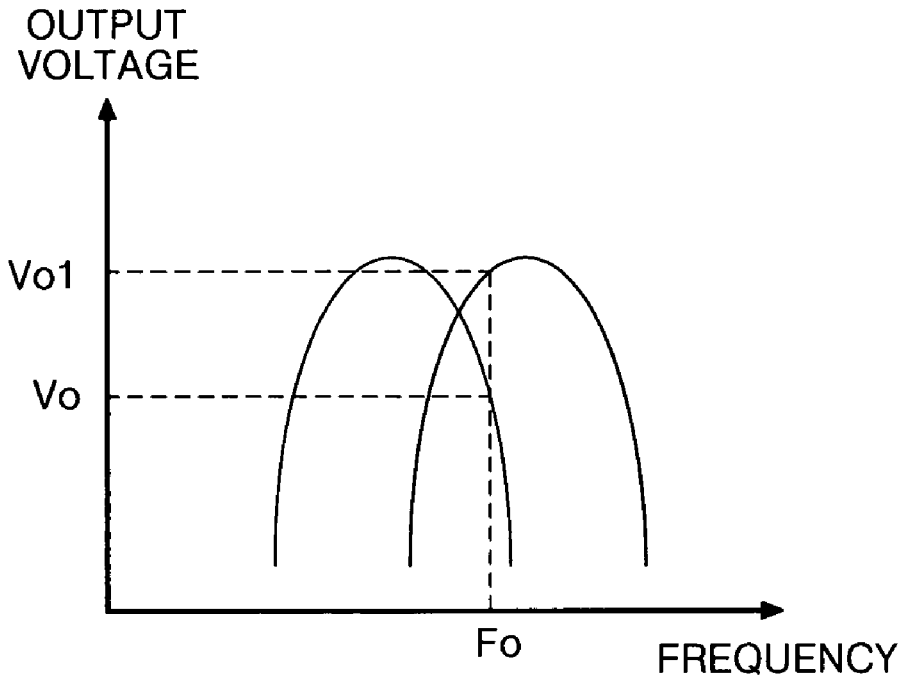
FIG. 6 is a diagram representing the change of an operating voltage and a starting voltage in accordance with the change of the surrounding environment in the same frequency.

FIG. 5 is a diagram representing the size of an operating voltage and a starting voltage in accordance with the state of a lamp. Specifically, after leaving the lamp 136 in an off-state in a dark environment at a low temperature, as shown in FIG. 5, the operating and starting voltages are higher than a threshold voltage at which a protection circuit operation would shut down the lamp 136. As shown in FIG. 6, if an output voltage for a normal operating frequency Fo of the lamp 136 is Vo in a normal state, when the lamp 136 is left in the dark environment, the curve shifts to the right so that the output voltage becomes Vo1 at the frequency Fo, thereby generating a voltage Vo1 higher than the normal value Vo. Thus, the operating voltage in the early stage shown in FIG. 4 is higher than the threshold voltage of the safety circuit 170, thereby causing a malfunction in lighting up the lamp 136. Accordingly, in a lamp driving device of a liquid crystal display device according to second and third embodiments of the present invention, there will be proposed structures which can solve such a problem.

Figure 7:
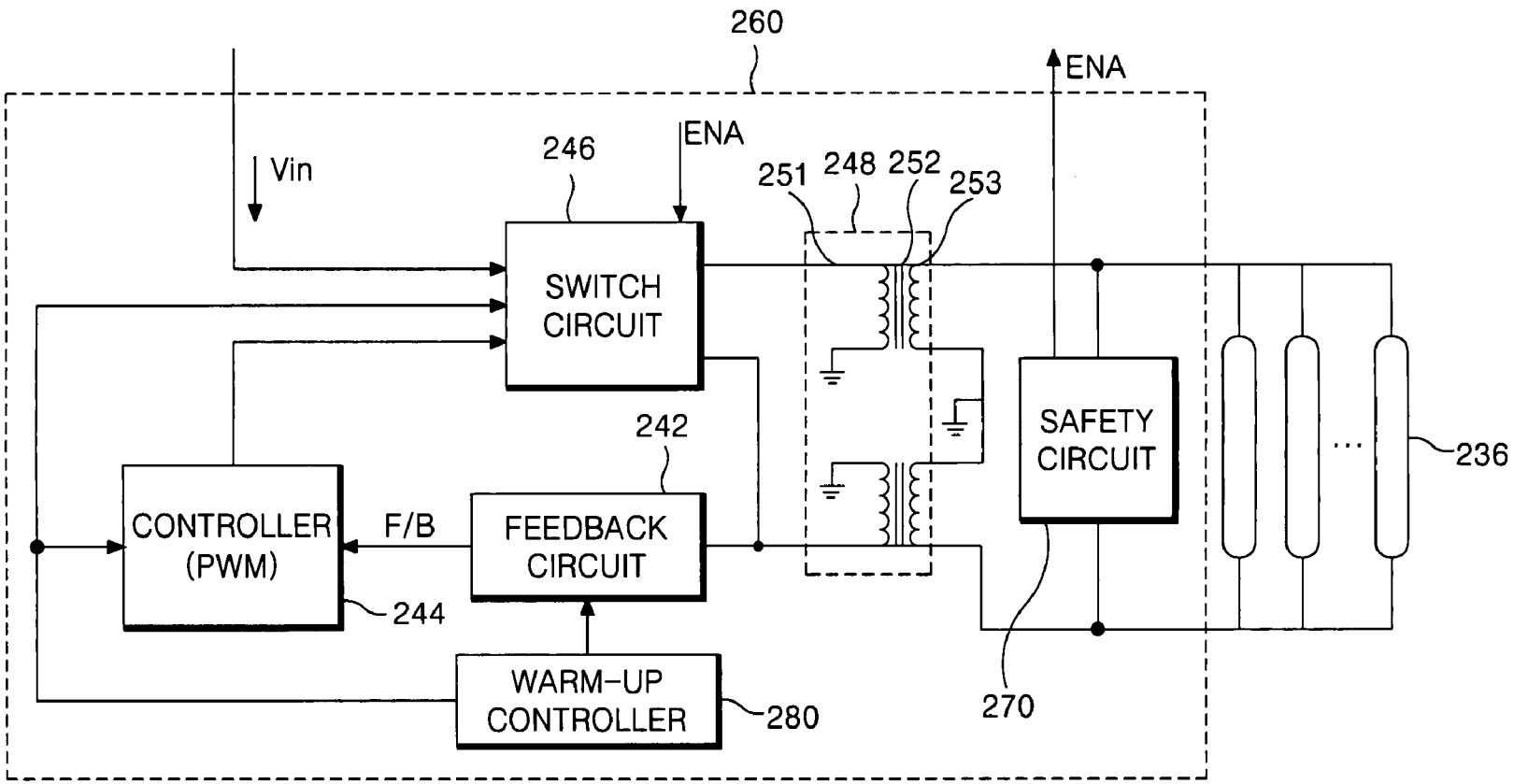
FIG. 7 is a diagram representing a lamp driving device according to a second embodiment of the present invention.

FIG. 7 is a diagram representing a lamp driving device of a liquid crystal display device according to a second embodiment of the present invention. Referring to FIG. 7, the lamp driving device 260 includes a switch circuit 246 to convert a DC power Vin received from an external power source into an AC signal provided to a plurality of lamps 236; a transformer 248 which boosts the voltage of the AC signal generated by the switch circuit 246 and supplies the boosted AC signal to the lamp 236; a feedback circuit 242 for detecting a current supplied to the lamp 236 from the switch circuit 246; a controller 244 for controlling the switch circuit 246 in accordance with a feedback signal generated by the feedback circuit 242; a warm-up controller 280 for controlling the voltage and current which are supplied when operating the lamp 236 in the early stage; and a safety circuit 270 which intercepts or maintains the current supplied to the lamp 236 by detecting the current supplied to the lamp 236 from the transformer 248. Herein, the safety circuit 270 can be connected across the input terminal and the output terminal of the feedback circuit 242.

Each of the lamps 236 includes: a glass tube; inert gas within the glass tube; and a cathode and an anode which are installed at both ends of the glass tube. The inert gas is filled into the glass tube and a fluorescent material is spread on the inner wall of the glass tube. A plurality of the switch circuits 246 receive the DC power from an external power source and convert the DC power into an AC signal.

Each of the transformers 248 includes: a primary winding 251; a secondary winding 253 for generating an AC high voltage induced by an AC voltage provided to the primary winding 251; and an auxiliary winding 252 disposed between the primary winding 251 and the secondary winding 253. The transformer 248 boosts the voltage of the AC signal generated by the inverter 246 to supply an AC high voltage to the lamps 236.

The feedback circuit 242 detects the AC high voltage generated by the switch circuit 246 to be supplied to the lamp 236, thereby generating the feedback voltage. The feedback circuit 242 can be located at an output terminal of the lamp 236 and detects an output value outputted from the lamp 236. The controller 244 receives a feedback voltage F/B generated by the feedback circuit 242 to control the switch circuit 246. The safety circuit 270 detects the AC high voltage, which is supplied to the lamp 236, inspects whether it accords with safety standards, and intercepts and maintains the current and voltage supplied to the lamp 236.

Figure 8:
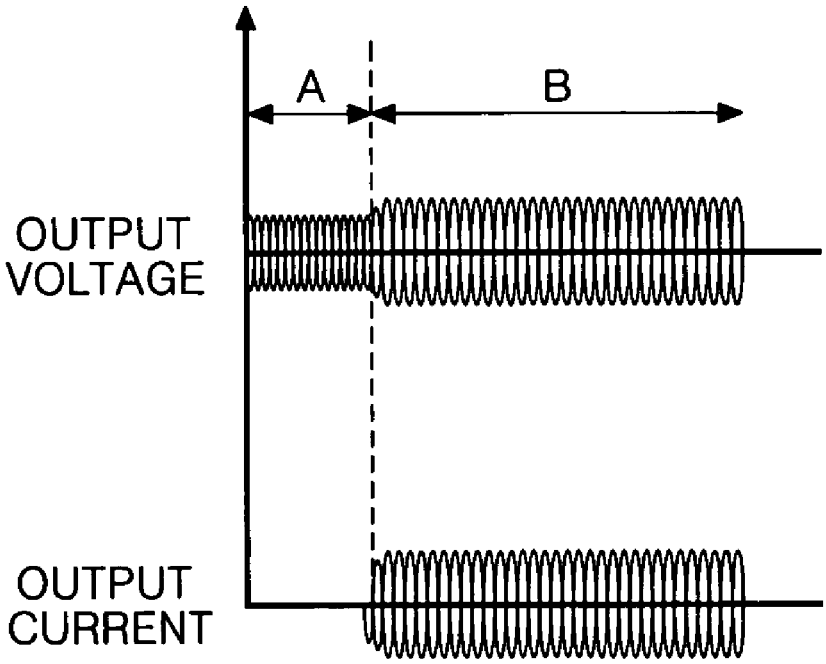
FIG. 8 is a diagram representing an output voltage and current generated by the lamp driving device of FIG. 7.

As shown in FIG. 8, the warm-up controller 280 divides an early operating period of the lamp 236 into a warming period (A) when the lamp 236 is warmed up for an early period and a normal period (B) when the lamp 236 is turned on normally after the warming period (A). To this end, the warm-up controller 280 can form the warming period (A) by controlling at least one of the feedback circuit 242, the controller 244 and the switch circuit 246. The warm-up controller 280 controls a feedback voltage F/B generated at the feedback circuit 242, controls a pulse width of the controller 244, or controls a switch timing of the switch circuit 246 to detect the warming period (A). The length of the warming period (A) can be adjusted differently in accordance with the characteristic of the lamp 236 such as the size of the lamp 236 and the characteristic of the surrounding environment. Further, the warm-up controller 280 enables warming the lamp 236 by controlling the switch circuit 246 to supply a voltage which is lower in the warming period (A) than in the normal period (B) and which is an offset voltage of less than or equal to a threshold point where no current is generated.

Figure 9:
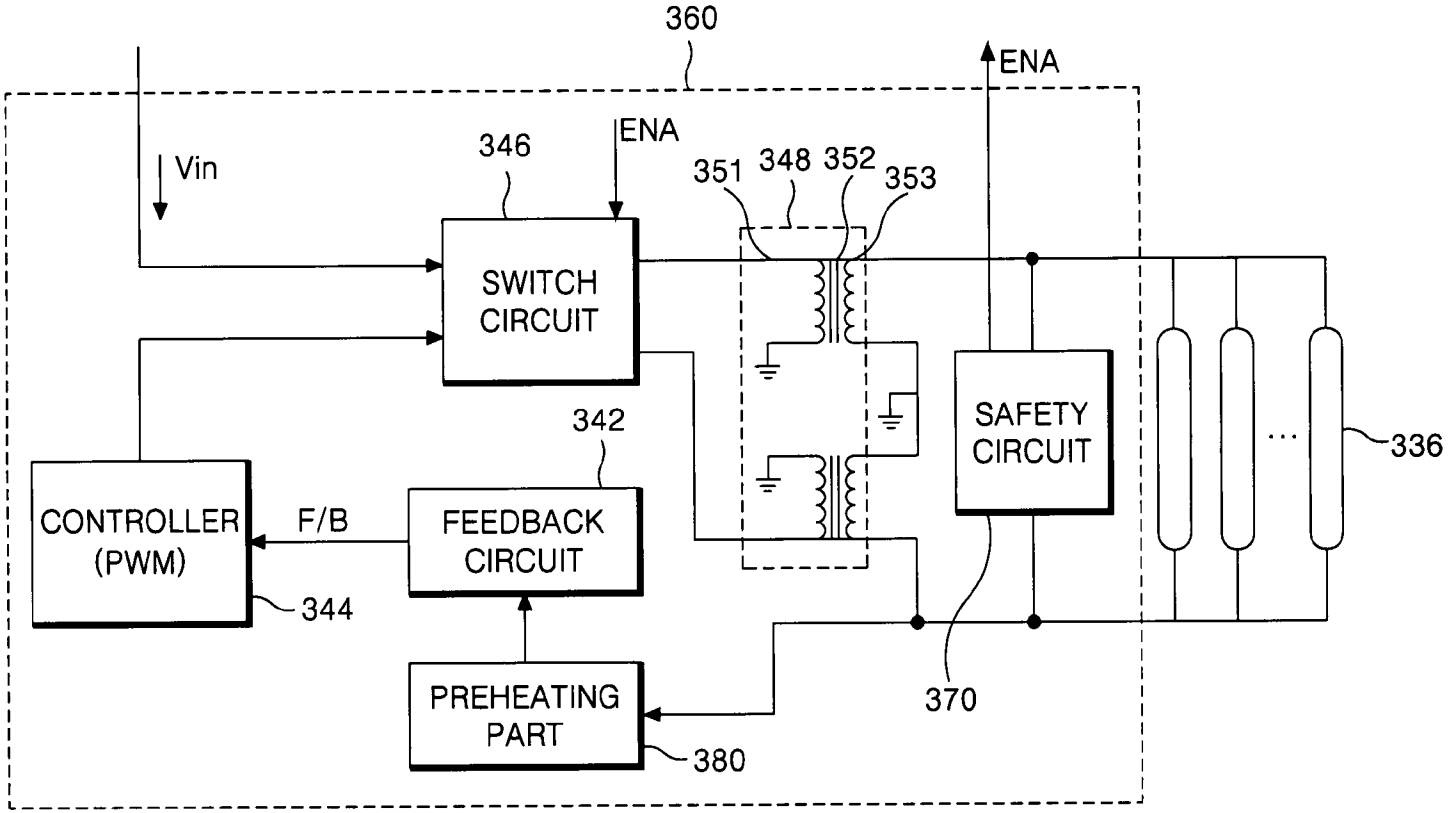
FIG. 9 is a schematic diagram of an exemplary lamp driving device for a liquid crystal display device according to a third embodiment of the present invention.

FIG. 9 is a schematic diagram of an exemplary lamp driving device for a liquid crystal display according to a third embodiment of the present invention. Referring to FIG. 9, a lamp driving device 360 includes: a switch circuit 346 connected to receive a DC power Vin from an external power source for converting the DC power into an AC signal; a transformer 348 which boosts the voltage of the AC signal generated by the switch circuit 346 and supplies the boosted AC signal to the lamp 336; a feedback circuit 342 for detecting a current supplied to the lamp 336; a controller 344 for controlling the switch circuit 346 in accordance with a feedback signal generated by the feedback circuit 342; a warming part 380 connected to the feedback circuit 342 for converting the feedback signal when operating the lamp 336 in the early stage; and a safety circuit 370 which intercepts or maintains the current supplied to the lamp 336 by detecting the current supplied to the lamp 336 from the transformer 348. The safety circuit 370 can be connected to each of the input terminal and the output terminal of the feedback circuit 342. The lamp driving device of the liquid crystal display device according to the third embodiment of the present invention has the same configuration as that of the first embodiment of the present invention except the warming part 380, thus a description for the configuration except the warming part 380 will be omitted.

Figure 10:
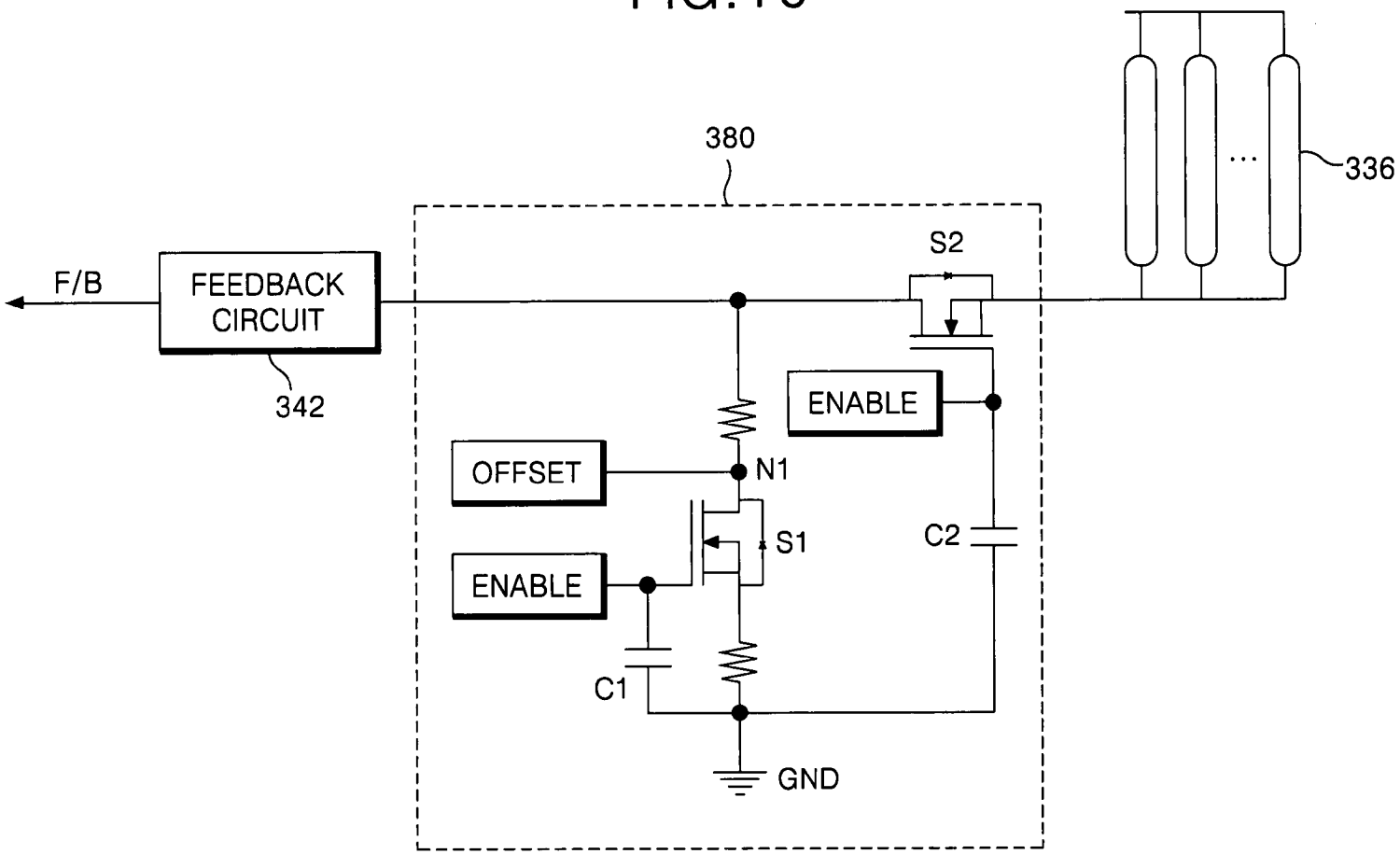
FIG. 10 is an exemplary schematic diagram of the warming part of FIG. 9.

FIG. 10 is an exemplary schematic diagram of the warming part of FIG. 9. As shown in FIG. 10, the warming part 380 includes: a first switch S1 connected between the lamp 336 and the feedback circuit 342; a first node N1 between the feedback circuit 342 and the first switch S1; a second switch S2 connected between the first node N1 and the ground GND; an offset voltage source OFFSET connected to the first node N1 to supply an offset voltage; an enable voltage source ENABLE connected to the base terminals of the first and second switches S1, S2 for supplying power; and first and second capacitors C1, C2 connected in parallel to the base terminals of the first and second switches S1, S2. A resistor can be connected between the feedback circuit 342 and the first node N1 and between the first switch S1 and the ground GND, respectively, for stabilizing the circuit.

The driving of the warming part 380 in the lamp driving device according to the third embodiment of the present invention will be explained in reference to FIG. 11.

Figure 11:
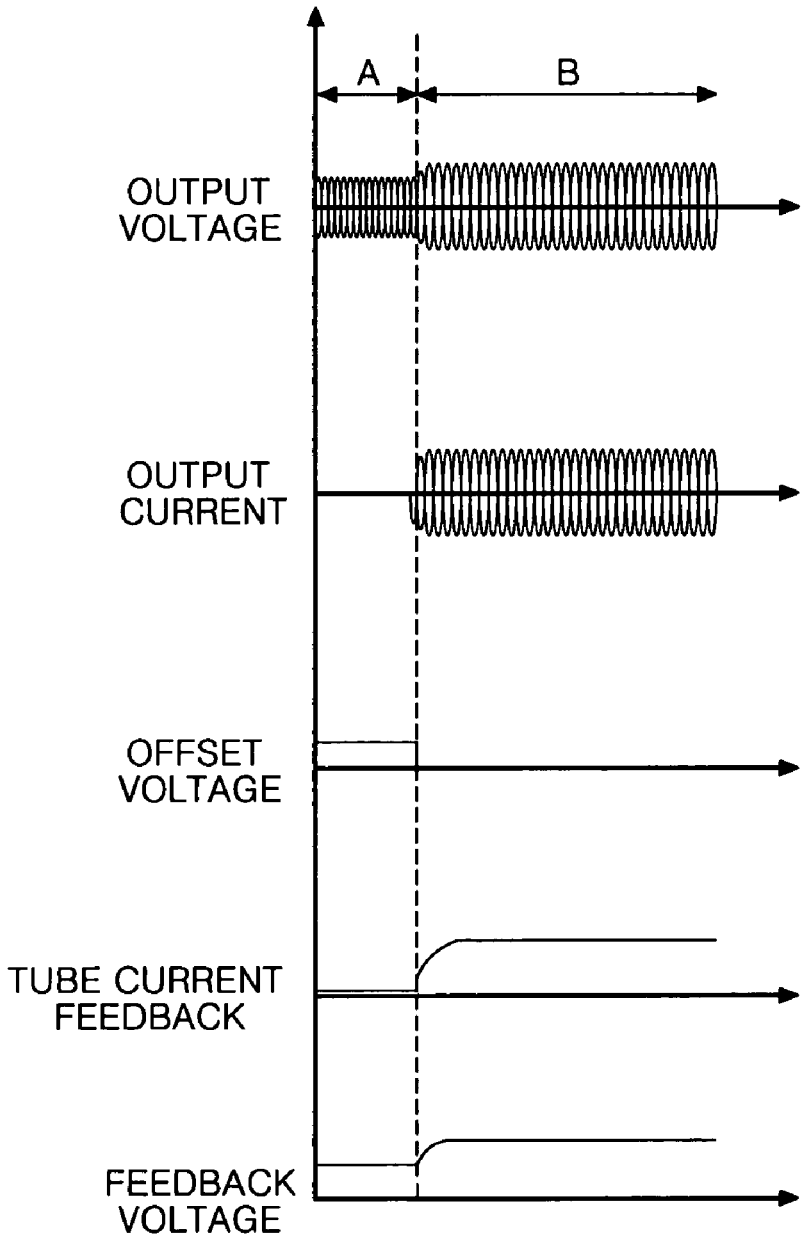
FIG. 11 is a diagram representing a plurality of signals in the lamp driving device of FIG. 9.

Referring to FIG. 11, during the warming period (A), no tube current is generated to be supplied to the feedback circuit 342 from the lamp 336, and the offset voltage source OFFSET of the warming part 380 is supplied to the feedback circuit 342. That is to say, the level of the offset voltage source OFFSET is set to be a voltage of less than or equal to a threshold point where no tube current flows even when a voltage is applied to the lamp 336. Accordingly, the feedback circuit 342 generates the feedback voltage F/B supplied to the controller 344 in accordance with the offset voltage. The controller 344 warms up the lamp 336 by generating an output voltage depending on the feedback voltage. Herein, the offset voltage of the warming part 380 is supplied to the feedback circuit 342 while the enable voltage source ENABLE charges the first capacitor C1. When the charge of the capacitor C1 is completed, the voltage of the enable voltage source ENABLE turns on the second switch S2 to ground the first node N1, thereby intercepting the supply of the offset voltage. On the other hand, the output voltage of the lamp 336 supplied to the feedback circuit 342 is intercepted by the first switch S1 during the warming period (A). Then, the charge of the second capacitor C2 is completed by the enable voltage source ENABLE and the second switch is turned on, thus the output voltage of the lamp 336 is supplied to the feedback circuit 342. Herein, the desired length of the warming period (A) can be set by appropriately setting the capacitances of the first and second capacitors C1, C2. Further, the enable voltage source ENABLE is activated when an early voltage is supplied to the lamp driving device, so as to be supplied to the warming part 380. That is to say, the warming part 380 is activated when an early power supply for initializing the liquid crystal display device is carried out.

As described above, the lamp driving device and method according to the embodiment of the present invention satisfies the safety standards of the liquid crystal display device and can prevent the malfunction of the lamp driving device according to the safety standards.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A lamp driving device, comprising:

a switch circuit for supplying a signal;

a transformer which boosts a voltage of the signal from the switch circuit and supplies the boosted voltage to at least one lamp;

a safety circuit which compares a threshold value with at least one of the boosted voltage and a current through the lamp, and intercepts at least one of the boosted voltage and the current through the lamp in accordance with the comparison result; and a warming part for warming the lamp in an early stage with a voltage less than or equal to the threshold value.

2. The lamp driving device according to claim 1, further comprising a feedback circuit for generating a feedback voltage by inspecting the at least one of the boosted voltage and the current of the at least one lamp.

3. The lamp driving device according to claim 2, further comprising a controller for controlling a switching timing of the switch circuit in accordance with the feedback voltage.

4. The lamp driving device according to claim 2, wherein the warming part is connected to the feedback circuit.

5. The lamp driving device according to claim 2, wherein the warming part includes a warm-up controller which supplies to the feedback circuit an offset voltage less than or equal to the threshold value that generates the current for a fixed period when the lamp is turned on in the early stage.

6. The lamp driving device according to claim 2, wherein the warming part includes:

a first switch connected between the lamp and the feedback circuit;

a first node between the feedback circuit and the first switch;

a second switch connected between the first node and a ground;

an offset voltage source connected to the first node for supplying an offset voltage;

an enable voltage source supplying power to base terminals of the first and second switches; and first and second capacitors connected in parallel to the base terminals of the first and second switches.

7. The lamp driving device according to claim 1, wherein the safety circuit shuts down the lamp driving device if at least one of the boosted voltage and the current through the lamp is greater than or equal to the threshold value.

8. A lamp driving device, comprising:

a switch circuit for supplying at least one of a voltage and a current for a lamp;

a warming part for warming-up the lamp during a warm-up period; and a safety circuit for intercepting the at least one of the voltage and the current through the lamp and preventing a lamp current feedback during the warm-up period.

9. The lamp driving device according to claim 8, further comprising a feedback circuit for generating a feedback voltage in accordance with the at least one of the voltage and the current of the lamp.

10. The lamp driving device according to claim 9, wherein the warming part is connected to the feedback circuit.

11. The lamp driving device according to claim 10, wherein the warming part includes a warm-up controller which supplies to the feedback circuit an offset voltage less than or equal to the threshold value that generates the current during the warm-up period.

12. The lamp driving device according to claim 9, wherein the warming part includes:

a first switch connected between the lamp and the feedback circuit;

a first node between the feedback circuit and the first switch;

a second switch connected between the first node and a ground;

an offset voltage source connected to the first node for supplying an offset voltage;

an enable voltage source supplying power to base terminals of the first and second switches; and first and second capacitors connected in parallel to the base terminals of the first and second switches.

13. The lamp driving device according to claim 8, further comprising a controller for controlling a switching timing of the switch circuit in accordance with the feedback voltage.

14. The lamp driving device according to claim 8, wherein the safety circuit shuts down the lamp driving device if the at least one of the voltage and the current through the lamp is greater than or equal to a threshold value.

15. A method of driving a lamp in an LCD device, comprising:

supplying a voltage;

boosting the voltage and supplying the boosted voltage to at least one lamp;

comparing a threshold value with at least one of the boosted voltage and a current through the lamp, and intercepting at least one of the boosted voltage and the current through the lamp in accordance with the comparison result; and warming-up the lamp in an early stage with a voltage less than or equal to the threshold value.

* * * * *